US006196151B1

(12) United States Patent
Grant et al.

(10) Patent No.: US 6,196,151 B1
(45) Date of Patent: Mar. 6, 2001

(54) DEVICE AND METHOD FOR AN INDEPENDENT MODULE OFFSHORE MOBILE BASE

(75) Inventors: Robert G. Grant, San Francisco; Richard C. Lundberg, Larkspur; Daniel K. Dolan, Pleasant Hill, all of CA (US)

(73) Assignee: Bechtel Group, Inc., San Francisco, CA (US)

( * ) Notice: Subject to any disclaimer, the term of this patent is extended or adjusted under 35 U.S.C. 154(b) by 0 days.

(21) Appl. No.: 09/193,055

(22) Filed: Nov. 16, 1998

Related U.S. Application Data

(63) Continuation-in-part of application No. 09/028,957, filed on Feb. 23, 1998, now abandoned.

(60) Provisional application No. 60/038,485, filed on Feb. 24, 1997.

(51) Int. Cl.[7] ..... B63B 35/44

(52) U.S. Cl. ..... 114/266; 114/261

(58) Field of Search ..... 14/69.5, 71.1, 14/71.5, 73.1, 27; 114/263, 264, 265, 267, 261, 258–259, 260

(56) References Cited

U.S. PATENT DOCUMENTS

| | | | | |
|---|---|---|---|---|
| 1,854,336 | * | 4/1932 | King | 114/265 |
| 2,238,974 | * | 4/1941 | Creed | 114/265 |
| 2,399,611 | * | 5/1946 | Armstrong | 114/261 |
| 4,580,517 | * | 4/1986 | Lundberg | 114/265 |
| 5,588,387 | * | 12/1996 | Tellington . | |

FOREIGN PATENT DOCUMENTS

| | | | | |
|---|---|---|---|---|
| 3630275 | * | 3/1988 | (DE) | 114/266 |
| 2241925 | * | 9/1991 | (GB) | 114/261 |
| WO 96/23961 | * | 8/1996 | (WO) | 114/261 |

* cited by examiner

*Primary Examiner*—Ed Swinehart
(74) *Attorney, Agent, or Firm*—Townsend and Townsend and Crew LLP

(57) ABSTRACT

A floating platform uses a plurality of modules to define a substantially continuous surface between at least two of the modules. In one embodiment, each module is substantially independently positioned. Relative positioning elements on the modules place the modules in a configuration maintaining a surface between two adjacent modules in a substantially continuous configuration. Preferably, the platform includes a runway connector spanning an operational distance between the modules. The connector preferably has an upper surface allowing for aircraft or wheeled vehicles to roll from the end of one module to an adjacent end of another module while the modules are free to move in all six degrees of freedom. Preferably, the runway connector will not hold the modules in position, instead relying on thrusters to maintain position. The runway connector may have an end surface maintained substantially in alignment and contact with a module end surface. In a specific embodiment, the runway connectors may be viewed as retractable and articulated ramps.

38 Claims, 18 Drawing Sheets

DEVICE AND METHOD FOR AN INDEPENDENT MODULE OFFSHORE MOBILE BASE

CROSS-REFERENCES TO RELATED APPLICATIONS

The present application is a continuation-in-part of and claims priority from U.S. patent application Ser. No. 09/028,957, filed Feb. 23, 1998 now abandoned , which is a continuation-in-part of Provisional U.S. Patent Application Ser. No. 60/038,485, filed on Feb. 24, 1997. The full disclosures of both applications are incorporated herein by reference for all purposes.

STATEMENT AS TO RIGHTS TO INVENTIONS MADE UNDER FEDERALLY SPONSORED RESEARCH AND DEVELOPMENT

This invention was made under contract with the United States Navy, Department of Naval Facilities Engineering under Government contract number N47408-93-D-7001, Delivery Order 8018. The Government has certain rights in this invention.

BACKGROUND OF THE INVENTION

The present invention relates generally to floating platforms on a body of water or other liquid. More particularly, the present invention relates to water-borne crafts which can form a long, continuous surface such as a runway capable of handling the takeoff and landing requirements of large fixed-wing aircraft.

Military and civilian aircraft operations in the world today often require landing facilities in areas remote and distant from land-based airfields, particularly in flights conducted over large bodies of water. Although military ships like aircraft carriers serve in some extent to fill these needs, these monolithic hulled ships are typically only 1000 feet in length and only capable of servicing the landing requirements of smaller single seat or multi-seat airplanes. Larger cargo aircraft such as the C-17 or the smaller C-130 would likely require runways on the order of about 5000 feet, and ships capable of servicing such aircraft do not currently exist.

The theoretical solution of building a large floating platform for landing airplanes like transport aircraft faces practical difficulties related to deploying such a large structure at sea. Wave and weather conditions, in sea states where these platforms would be needed, place enormous stress on the structural integrity of such a platform. The lack of such a floating platform in the world today can be attributed in part to the technical challenges presented by the inclimate conditions encountered at sea.

Earlier attempts to design a suitable ocean-going platform proposed a conventional monolithic floating structure. In these cases, tests revealed that the vertical plane bending moment caused by waves was beyond the limits of the rigidly formed monolithic hull. The monolithic hull was too long to handle tumultuous wave conditions. Its transverse bending and torsional resonant periods in the zone of wave periods and its wave induced bending and torsional moments were not acceptable.

Other prior designs attempted to address this problem by de-coupling the modules in one degree of freedom, such as using hinges between modules to decouple the pitch degree of freedom. However, none of the remaining five degrees of freedom at the module interfaces were de-coupled. These designs were technically infeasible due to excessive transverse bending and torsional loads, and a transverse bending resonant period in the region of the exciting wave periods. While there is merit in the concept for pitch-axis stability, the concept was unsatisfactory as it lacks structural integrity in both transverse bending and torsion (i.e. yaw and roll). Sea states within which the platform operates would likely produce waves that would destroy such a structure.

Further design concepts proposed the use of universal joints to eliminate the large moments and resonant periods. However, the shear loads in the connectors are excessive, 10 to 100 times larger than typical in the design of floating oil field equipment. Structural elements capable of resisting the huge loads would be impractical to build. As mechanical loads under design wave conditions are far too great for connections between the modules can withstand, a practical concept for an inter-module connector that fixedly attaches modules that could mechanically stabilize the structure in all three axes is infeasible.

Accordingly, it is desired to design a floating platform capable of withstanding torsion and transverse bending loads/resonant dynamics encountered in unstable, high seas. It would further be desirable if the floating platform were included a runway capable of handling the operational takeoff and landing needs of large, fixed-wing cargo aircraft.

SUMMARY OF THE INVENTION

The present invention is directed towards a floating structure of sufficient size to handle the needs of nearly all aircraft which uses positioning devices that can withstand the wave conditions encountered at sea. The present invention contemplates a much larger floating structure able to handle multi-ton transport aircraft and civilian airliners. In the exemplary embodiment, the present invention would have a runway 5000 feet in length. A preferred conceptual design would provide for an aircraft runway to be connected between modules or Sub Base Units (SBUs) which are independently positioned while having runway bridges allowing for six degrees of freedom between each module. The independent module concept solves the high connector load problems exhibited in previous designs by substantially eliminating load-bearing connectors between modules. The runway bridge is not a connector, in the traditional sense, as it transfers almost no load between the modules for module positioning purposes. The concept preferably solves the strength and dynamic response issues by subdividing the platform into a sufficient number of smaller more feasible independent modules comprising relative position keeping elements and bridges for providing substantially continuous runway surfaces.

In one aspect, the present invention provides a floating platform comprising a plurality of floating modules having positioning thrusters adapted to position the modules to define a substantially continuous runway across at least two of the modules. One of the modules typically has an extension or bridge in slidable, releasable contact with an adjacent module when the runway is in a continuous configuration. The bridge is usually adapted to allow for six degrees of motion between adjacent modules so as to minimize the stress on the extension. Preferably, the positioning of the modules to maintain the substantially continuous runway will be accomplished by the positioning thrusters. More preferably, the bridge or extension has an upper surface allowing for aircraft to roll from the end of one module to an adjacent end of another module when the modules are moving in all six degrees of freedom. The runway bridge will preferably not hold the modules together. In a specific embodiment, the runway connectors may be viewed as retractable and articulated ramps. The runway bridge may have an end surface maintained substantially in alignment and contact with an module end surface.

In another aspect, the present invention provides a floating platform comprising a donor module and a receiver module. The modules have dynamic positioning elements and a connecting bridge spanning an operational distance between the modules. A first portion of the connecting bridge extends from the donor module and a second portion extends from the receiver module. A sliding interface may be defined between the first portion and the second portion. Specifically, the first portion defines a first connecting surface and the second portion has a second connecting surface where the connecting surfaces remain in substantial contact with one another. The first portion from the donor module preferably contacts a landing region on the receiving module. This advantageously allows the connector to rest on the receiver module. The second portion usually has a spring damper system pushing against the first portion.

In a still further aspect, the present invention provides a connection assembly for spanning an operational distance between adjacent floating modules. The assembly includes a bridge element mountable on one of the modules, a yaw compensation assembly, and a gap closure assembly. The bridge element and assemblies form a substantially continuous surface between adjacent modules when the connection assembly spans the operation distance. Preferably, the connection assembly is configured to allow for six degrees of relative motion between modules while maintaining a continuous surface between modules. In some embodiments, the gap closure assembly is mounted on a receiver module, the yaw compensation assembly mounted adjacent the gap closure assembly, and the bridge element is pivotally mounted on a donor module and having first and second positions. The bridge element is typically releasably connected to yaw compensation assembly on the receiving module when in the first position, and disconnected from the assembly in the second position. The connecting bridge may further include extendable damping jacks near a distal end or engaging surface of the bridge element. The bridge element may be made from steel, aluminum, or fiber reinforced plastic.

In another aspect, the present invention provides a method of forming a floating runway from a plurality of floating modules. The method involves positioning the plurality of floating modules relative to the position of one of the modules. Thrusters may be used to maintain an operational distance between the modules. The method further includes maintaining a substantially continuous surface between at least two adjacent modules within the operational distance when said modules are moving in six degrees of freedom relative to one another. In preferred embodiments, the method involves coordinating the power and direction of the thrusters to minimize surge velocity, sway velocity, and yaw velocity between modules.

A further understanding of the nature and advantages of the invention may be realized by reference to the remaining portions of the specification and the drawings.

DESCRIPTION OF THE SPECIFIC EMBODIMENTS

I. OVERVIEW

Figure 1:
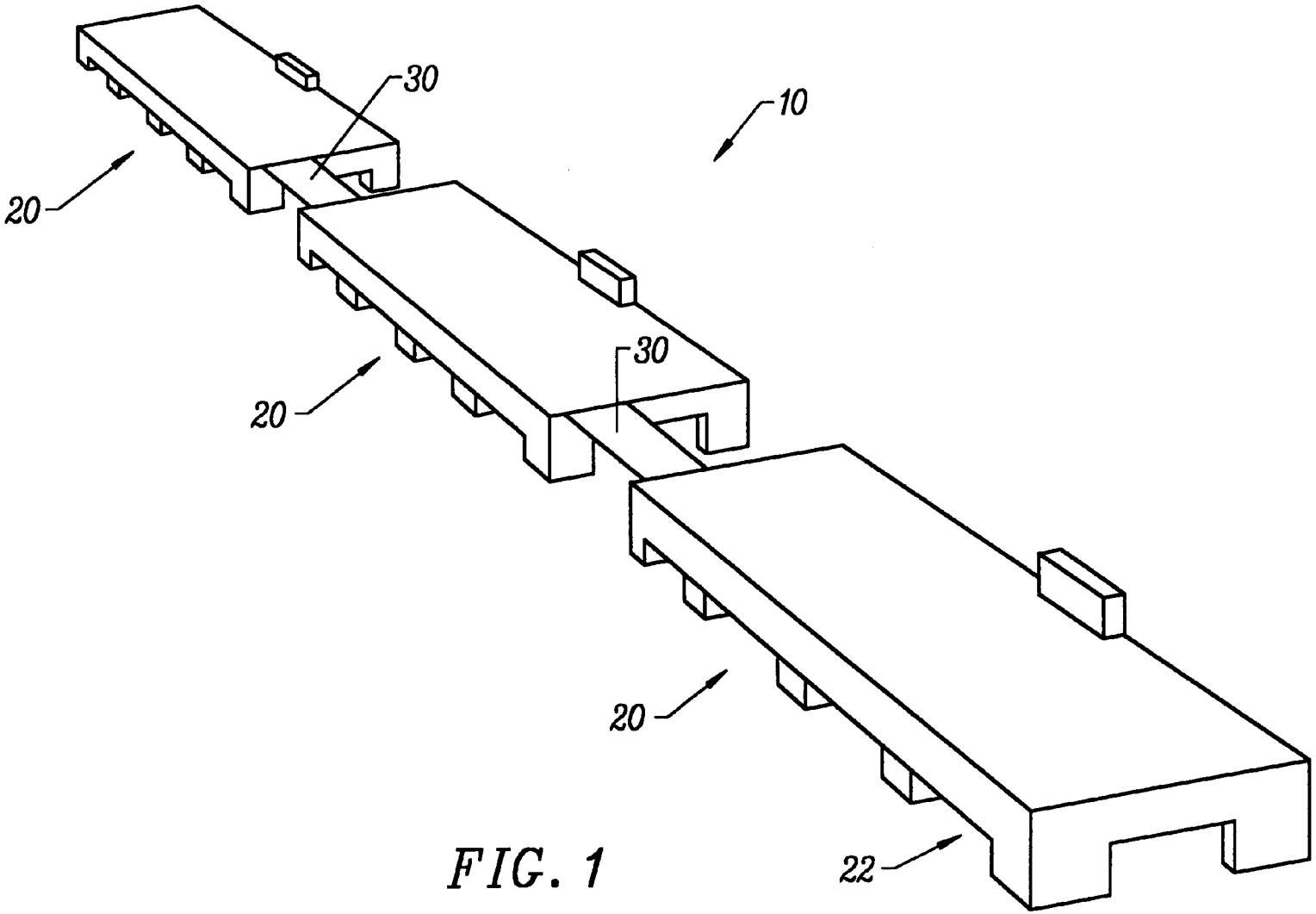
FIG. 1 is a perspective view of a preferred embodiment of the present invention.

The present invention is directed towards a floating platform having, in the preferred embodiment, a 5000 foot runway for conducting air operations with fixed wing aircraft. The present invention comprises a plurality of independent modules in close relative position and having a connection bridge therebetween for forming a continuous runway across the modules. Although the present invention is particularly usefully in handling military aircraft, it should be understood that the floating platform is not restricted in such manner and is easily adaptable for use with civilian air transports and the like.

Advantageously, the runway connectors transfer almost no load for positioning, with the modules substantially positioned together by dynamic positioning elements on each module to control the mean relative position between each module to allow for air operations to be conducted in reduced seastates.

Preferably, each module is configured to be as long as possible to minimize its wave motions. Relative motion at the interface between modules is minimized when the wave length projected on the mobile offshore base (MOB) equals the length of the module. However, if the modules get too long, they will exhibit the monolithic hull's structural difficulties. In the preferred embodiments, the MOB should be subdivided into at least three modules to control resonant periods and torsional moments.

To address the problem of constructing a structure capable of withstanding the excessive structural stresses encountered at sea, the present invention proposes constructing a floating platform formed from several individual floating subunits or modules. The subunits are preferably not structurally connected to each other except by a bridge element or deck continuity element which transfers substantially no force in positioning of the subunits or modules. The bridge element is only designed as a continuity element to span the operational distance between the modules. By relying substantially on other methods to maintain relative position, the present invention eliminates many of the structural concerns associated with deploying such a large structure at sea.

To form the long runway structure, the modules will be positioned together by using dynamic positioning technology. Preferably, no inter-module interconnections will be required or will not be relied upon to maintain a substantially continuous surface between the modules, as no practical concept for a mechanical interconnection has emerged which will withstand the design conditions. Hence, any connector between modules typically does not have a fixedly secured connection to both modules. The connection between modules preferably do not transfer tensioning load sufficient to prevent separation beyond an operational distance between modules. When sea conditions approach a dangerous or operationally limiting level (and aircraft could not land safely anyhow), the semi-submersible modules would be moved safely apart using the dynamic positioning methods incorporated in the design. When conditions permit, the modules would be repositioned to provide the full-length runway.

FIG. 1 shows a preferred embodiment of the Mobile Offshore Base (MOB) or floating platform 10 comprising three independent Sub Base Units (SBUs) or modules 20. During relatively mild environmental conditions when air operations are possible, the modules 20 will be dynamically positioned relative to each other, and the gap (approximately 35 m in this example) between modules will be spanned by an extension such as runway bridge 30 that accommodates relative motions between modules. The bridge 30 helps to maintain the runway in a substantially continuous configuration. When weather conditions become excessive, the runway bridges 30 can be stowed and the modules 20 separated to a safe distance to ride out the weather. Analyses using accurate histories of directional wave spectra and wind speed/direction at four sites in the world indicate that this concept can perform air operations a majority of the time.

Although the size and design of each module may vary, the length of each module is preferably chosen to be as long as practically possible to minimize motions but short enough for each module to be strong enough to resist wave action under the required design conditions. Waves are ineffective in producing disturbances in the module 20 if they are short relative to the length of the module. The present invention works in part because everyday waves at most locations in the world have periods and lengths that are too short to be effective in creating a significant dynamic runway angle. Analysis shows that a structure with three semi-submersible modules would be sufficient for the specific design task. Using only two modules for a 5,000 foot structure would still require individual modules of an excessive length, presenting many structural design problems. An exemplary embodiment of module 20 is about 1600 feet in length and about 400 feet in width. They may have a total displacement of about 638,000 tons with a steel weight of about 247,000 tons. The modules preferably have a hull design which have openings 22 that allow for lateral currents to pass easily around the hull structure.

Figure 2:
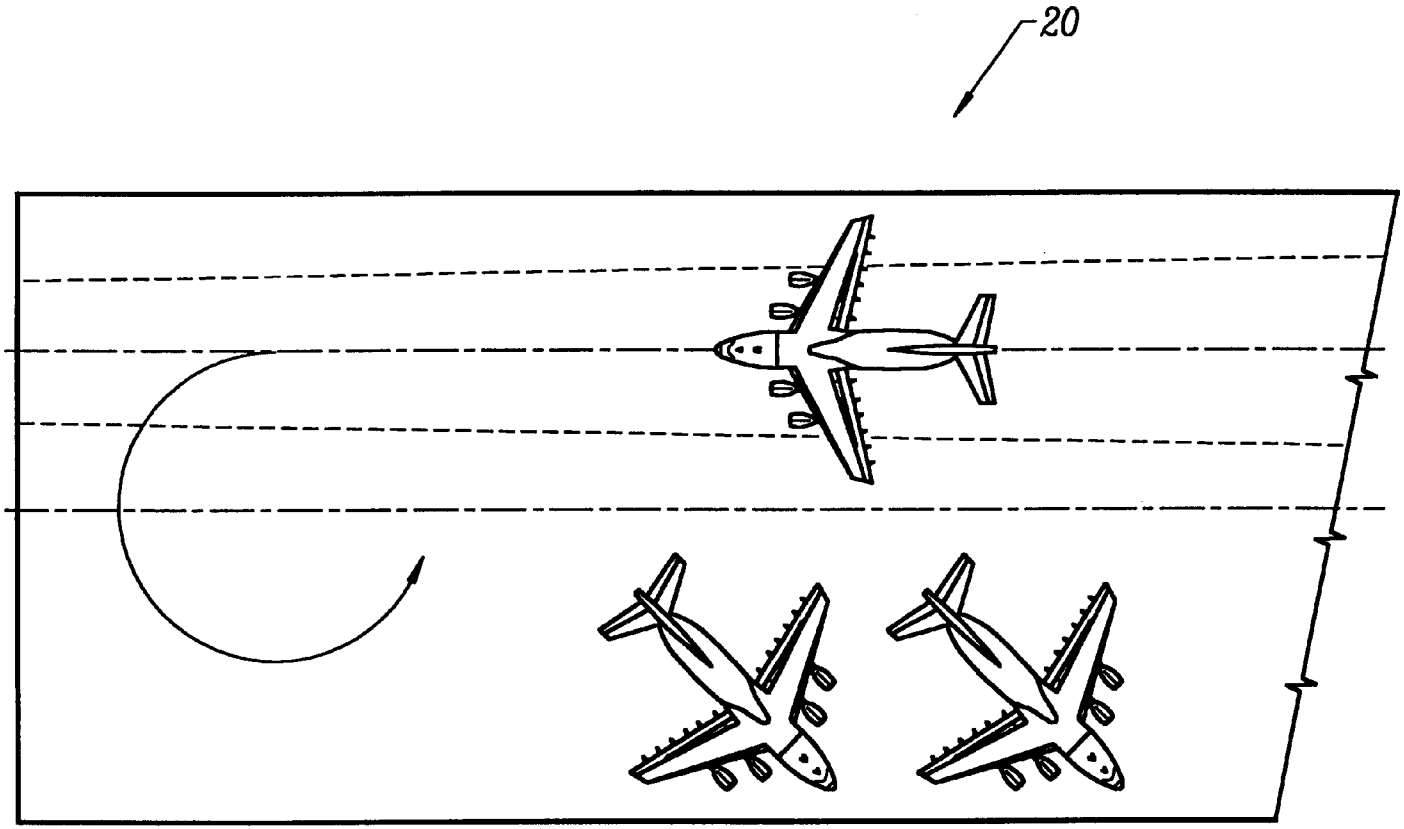
FIGS. 2–5 show various side views and cross-sections of a module according to the present invention.

FIG. 2 shows that each module 20 is capable of supporting aircraft having wing spans of about 50 meters The modules 20 may each carry a payload of about 100,000 tons. The payload capacity of each module in addition to its flight deck size allows the floating platform 10 to operate as a forward supply point for many types of military and civilian operations.

Figure 3:
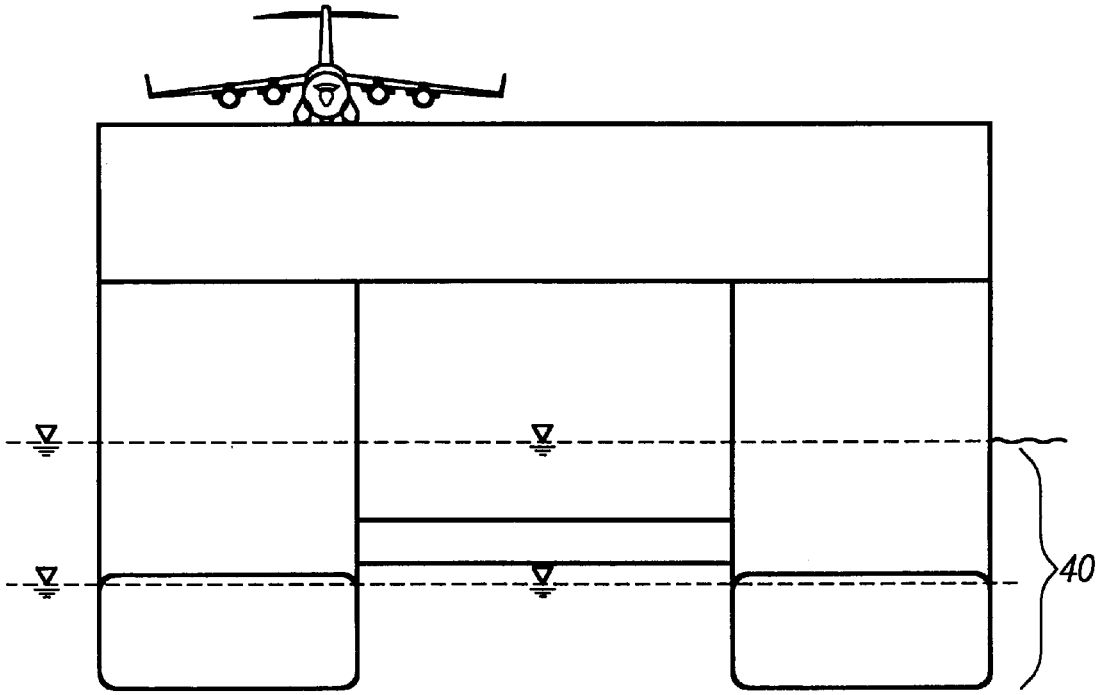
Figure 4:
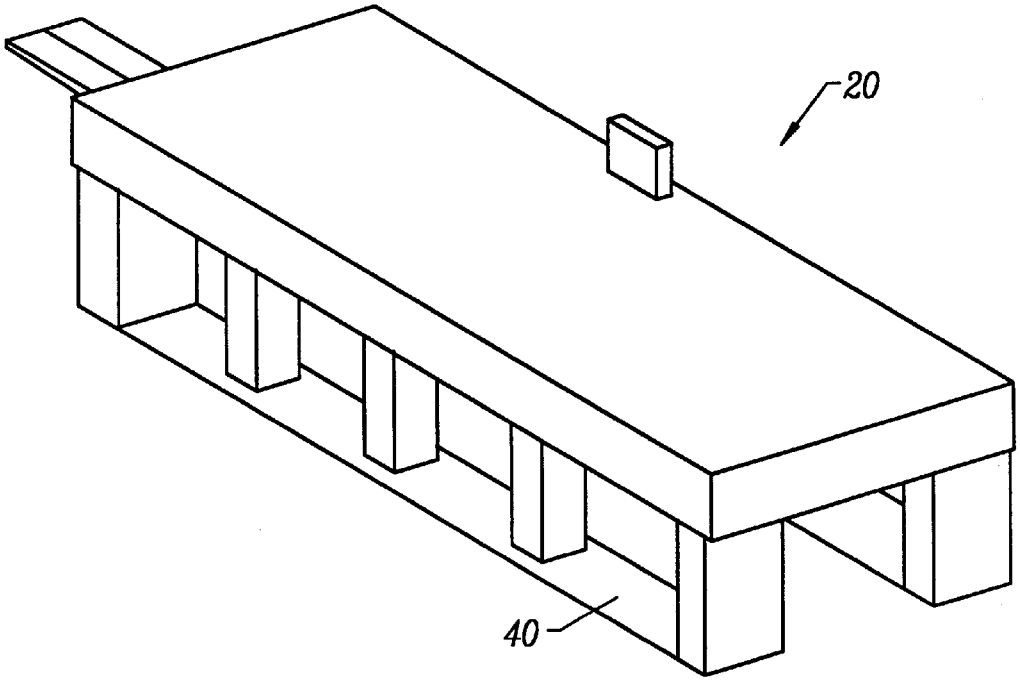

The modules 20 are also preferably designed to be semi-submersible. Partially submerging the modules 20 during flight recovery and takeoff operations further minimizes wave motion. An exemplary embodiment of the floating platform 10 preferably uses modules 20 having a pontoon configuration as shown in FIGS. 3 and 4. Pontoon portions 40 of the module 20 may be flooded with ballast water or other fluids to lower the height of floating platform 10. This increases platform stability and allows the platform to remain operational for aircraft landing and takeoff during more severe wave conditions. In the embodiment of FIG. 3, approximately 35 meters of the platform is submerged during flight operations while only about 14.2 meters are submerged when the module 20 is in transit mode. Decreasing pontoon depth during transit, as shown in FIG. 4, reduces drag, module weight, and risk of hull damage when module 20 passes through shallower waters.

Figure 5:
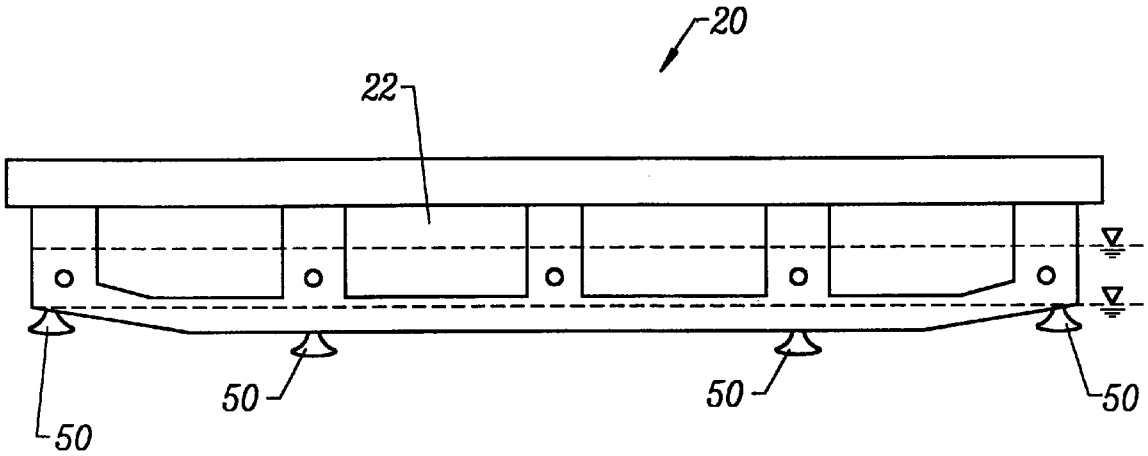

The modules 20 are typically self-propelled vessels having a plurality of azimuthing thrusters 50 as illustrated in FIG. 5. The azimuthing thrusters 50 have a swiveling device 52 to allow the output of the thrusters to be directed as needed. The module 20 usually has eight, retractable azimuthing thrusters 50 preferably having at least 15,000 horsepower (HP), more preferably at least 19,000 HP, and most preferably at least 25,000 HP. The thrusters 50 can propel the module 20 at speeds exceeding 15 knots. The retractable quality of the thrusters 50 further increases the ability of module 20 to enter areas of shallow water such as harbors. Their azimuthing capability allows the thrusters 50 to be directed as desired to maintain the module in a relative location during flight operations. It should understood that other maneuvering thrusters of sufficient power may also be used with or in place of the azimuthing thrusters 50.

II. DYNAMIC POSITIONING

The dynamic positioning (DP) system 100 (FIG. 7) keeps the relative positions of modules 20 within the horizontal and various other motion limits of the runway bridge 30. In a specific embodiment, the runway bridges 30 are configured to accommodate about plus or minus 7 m of relative motion. The dynamic positioning element may include a plurality of thrusters 50 to provide control force necessary to maintain an operational distance between the SBUs. Discussions with oil exploration rig DP system design experts indicate that those rigs can maintain their position to a tolerance on the order of plus or minus 2 to 4 meters if enough power is available for correcting position errors after resisting the mean environmental loads. For drilling vessels, this required reserve is on the order of 20% of the total thruster power. However, this ratio may be different for the MOB because, in specific embodiments, each SBU is 30 to 50 times more massive than a conventional drilling vessel and will be powered with about 10 times the horsepower.

Dynamic positioning has traditionally been restricted to positioning against a non-moving point of reference. The present invention uses a dynamic positioning system 100 where at least two and possibly three moving objects are positioned relative to one another. The present invention may also involve positioning first and third modules about a stable, non-moving second module.

Figure 6A:
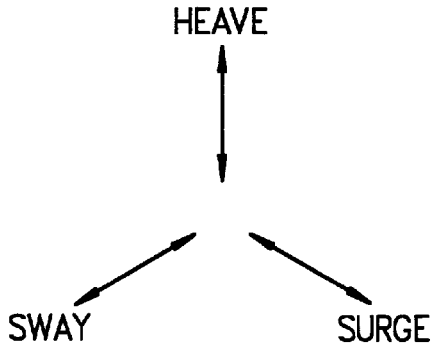
FIGS. 6A–6C shows the six degrees of freedom for a floating vessel.
Figure 6B:
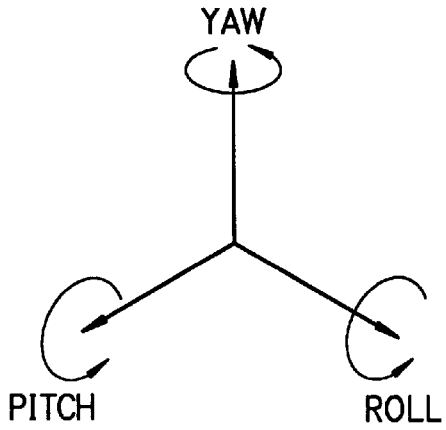
Figure 6C:
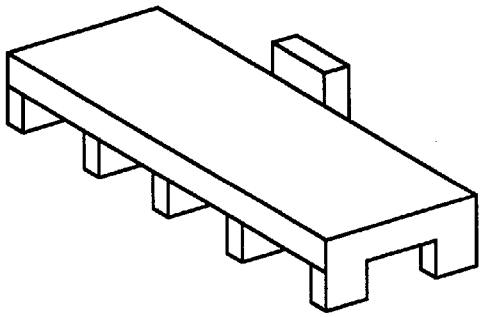
Figure 7:
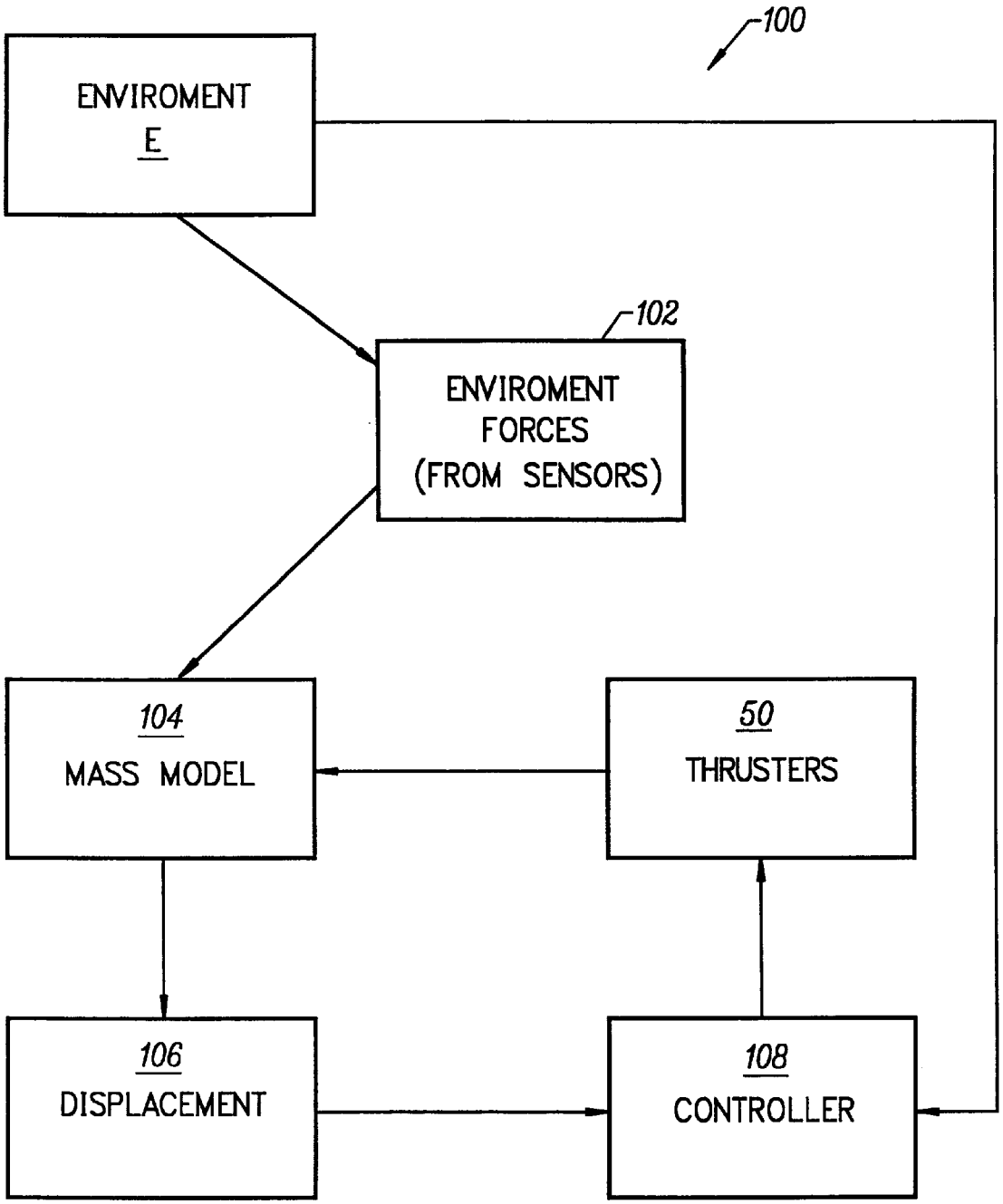
FIG. 7 is a schematic of a dynamic positioning system according to the present invention.

Generally, the dynamic positioning system 100 solves for three variables (surge velocity, sway velocity, and yaw velocity) and coordinates power and direction of each thruster to minimize these variables as desired. FIGS. 6A–6C illustrate the various degrees of motion associated with each module 20. FIG. 7 shows a simplified block diagram of the dynamic positioning system 100. The environment E generates forces which are detected by sensors 102 such as radar, accelerometers, laser range finders, and the like. These sensors translate the forces into information that is included in a mathematical mass model 104 of the module 20 or even the floating platform 10. The desired displacement 106 is calculated, passed on to the controller 108, which then adjusts each thruster 50 as desired.

The velocities (surge, sway, yaw) detected by sensor 102 are coordinate transformed to an earth fixed coordinate system and then integrated to solve for position and heading. The position is coordinate transformed back to body axes where the wave-induced motions are compensated. The total motion for each module is finally re-transformed into the earth-fixed frame. The controller 108 comprises of a proportional-integral-derivative (PID) algorithm with a wind feed-forward algorithm. A suitable dynamic positioning system is described in further detail in a Final Report entitled "Mobile offshore Base Dynamic Positioning System Configuration Study" dated January 1998 (submitted to Bechtel National, Inc. by Raytheon Systems Company), the full disclosure of which is incorporated herein by reference.

III. RUNWAY CONTINUITY ELEMENT

During inclimate weather, the modules 20 may move in all six degrees of freedoms as illustrated in FIGS. 6A–6C. The connecting bridge or runway continuity element 30 is preferably able span the gap between modules and also be able to accommodate all six degrees of relative motion while, substantially retaining continuity of the deck surface between modules. In addition, the continuity element 30 should be simple to engage and disengage while the modules 20 are moving relative to each other.

Figure 8:
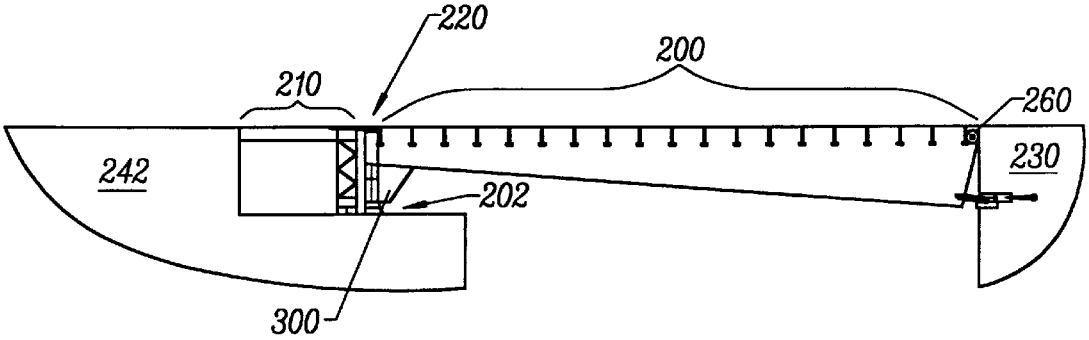

Referring now to FIG. 8, these goals may be accomplished by separating the runway connection system into subsystems each of which only has to address a part of the problem associated with unstable sea states. As described in further detail below, the three subsystems are the bridge 200, the gap closure unit 210, and the yaw compensation system 220 (FIG. 8). The system ends up as three relatively less complicated subsystems rather than one, complex system. Additional details of the subsystems can also found in a report entitled "Draft—Runway Bridge Configuration Studies and Conceptual Design, Volume 1" dated February 1998, prepared by Bechtel National, Inc., the full disclosure of which is incorporated herein by reference.

A. BRIDGE ELEMENT

Figure 9:
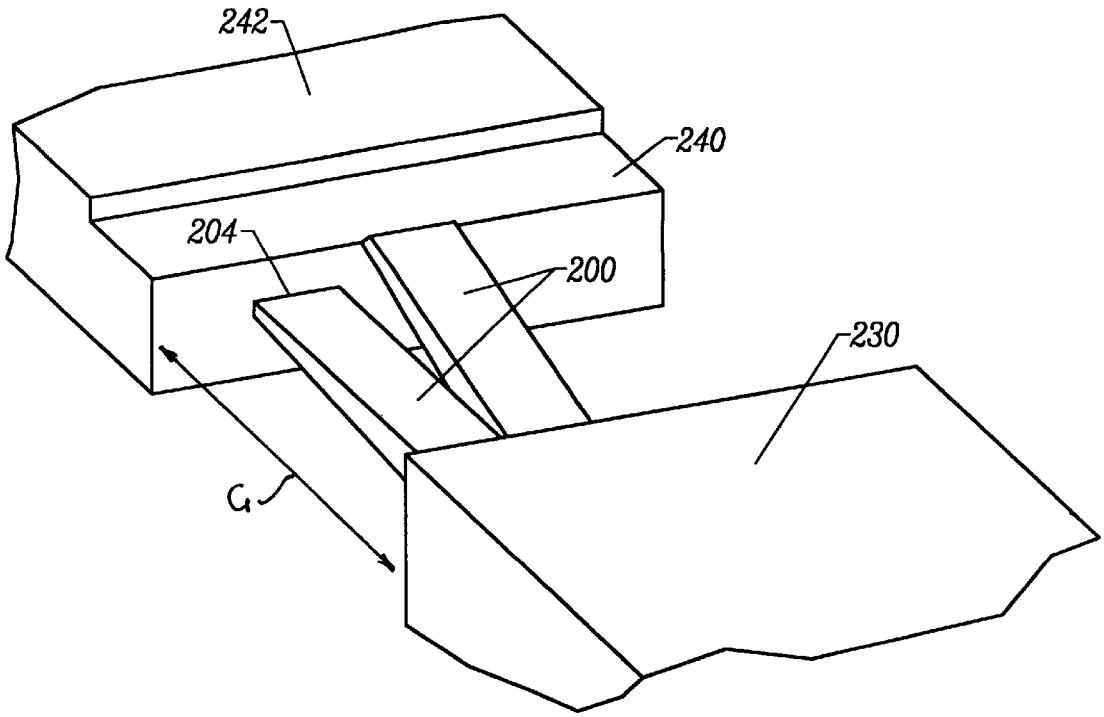
FIGS. 8–11 show embodiments of a runway connector according to the present invention.

Referring to FIG. 9, the runway bridge or bridge element 200 is typically a stiffened deck panel hinged at a proximal end to the donor module 230. In a preferred embodiment, each bridge is about 100 feet wide and 150 feet long. This size allows for a larger gap or operational distance between modules 20 and adequate ground effect surface for the C-17 aircraft. Dual bridges 200 are used to reduce the number of long spans, heavy framing, and very large lift jacks required. Each bridge 200 can be engaged and disengaged separately. The bridge 200 is flexible in torsion, resting on castors 202 (FIG. 8) at the distal end 204 and hinged at a proximal end 205. In some embodiments, the bridge 200 may be described as a retractable and articulated ramp.

When deployed, the distal end 204 of the bridge 200 (FIGS. 8–9) rests in a recess or landing zone 240 on the receiving module 242 so that the upper surface or deck 243 remains flush. The bridge 200 serves to span the rather large gaps G between the modules 20. When the bridge 200 engages the receiving module 242, the distance of the gap G is termed the operational distance between modules. The dynamic positioning system 100 (along with maintaining alignment of the modules) strives to maintain the gap G within the operational distance. The operational distance varies, depending on the length of the bridge 200. Typically, the operational distance may be between about 100 and 150 feet, preferably between about 105 and 145 feet.

Figure 10A:
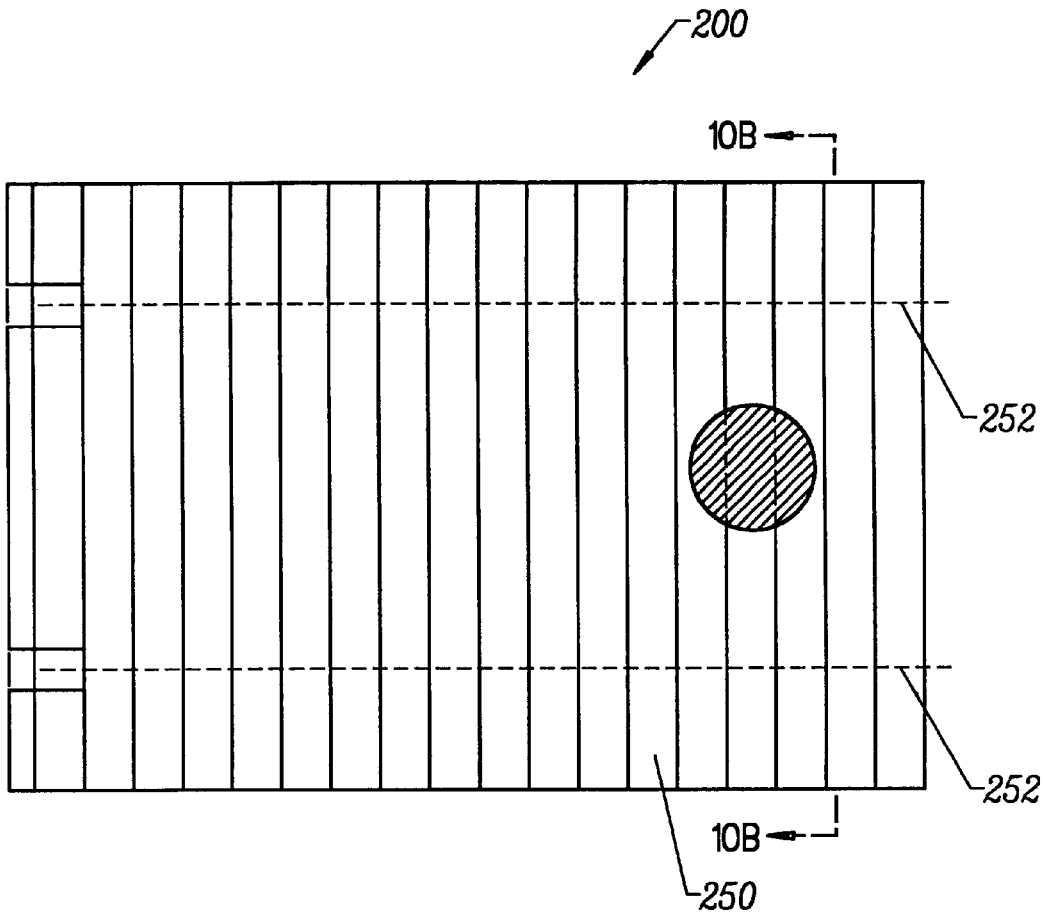
Figure 10B:
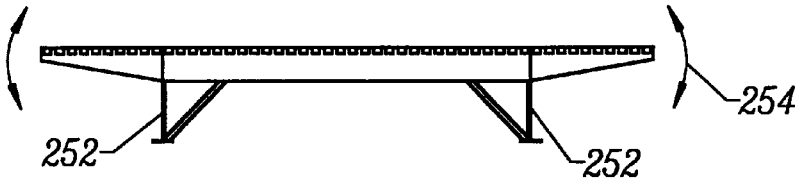

Referring now to FIGS. 10A and 10B, in order to accommodate relative roll between modules 230 and 242, the bridge 200 must be torsionally flexible (FIG. 21) to allow the bridge to match the various roll angles between modules, providing a smooth transition between the modules 230 and 242. In the preferred embodiment, the bridge 200 is longitudinally stiff, but more flexible latitudinally to accommodate for roll. Generally, the relative roll is generally quite small, with a maximum of only 2 degrees for the most extreme connected condition. The flat, stiffened plate panel 250 is preferably a nominally flexible structure. The main girders 252 are more flexible (as indicated by arrow 254) due to their open, wide flanged shape.

A variety of different materials and sizes may be used for the deck to minimize weight while providing requisite structural strength. In one embodiment, the deck is 5/16 inch thick high strength steel. The bridge 200, however, may also be made of materials such as aluminum and certain fiber reinforced polymers. The deck is supported by wide flange stringers which in turn are supported by 8 ft. deep transverse plate girders. This system is designed for the large vertical loads and provides high lateral stiffness and strength. However, as mentioned above, the bridge 200 is soft torsionally allowing it to twist or rack to accommodate for relative roll.

Figure 11:
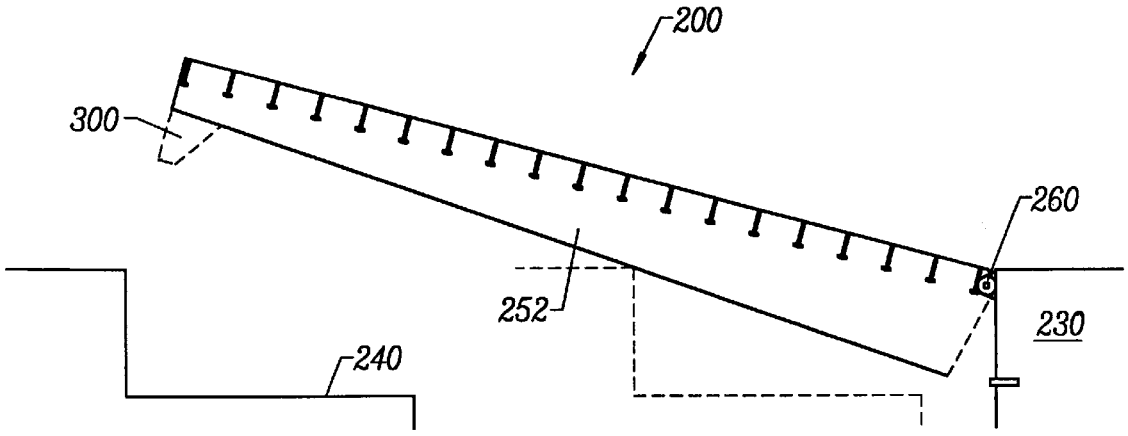
Figure 12:
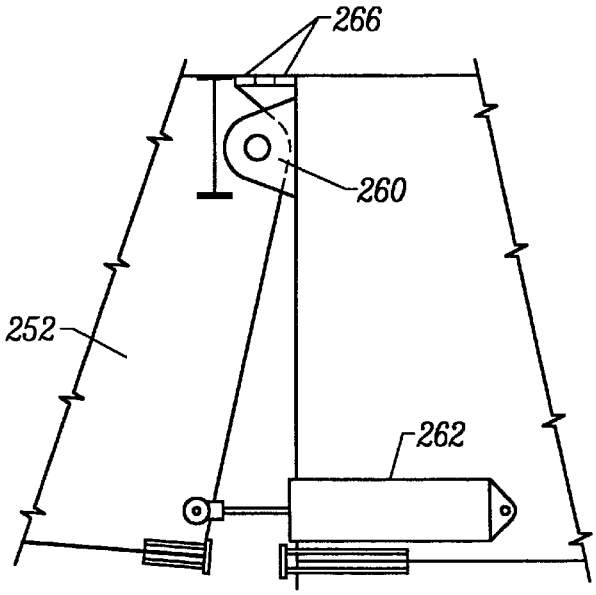
FIGS. 12–13 are cross-sections of a joint on the runway connector.

Referring now to FIG. 11, the wide flanged girders 252 are cantilevered from the donor unit 230 at a hinge 260. The hinge 260 is located at the top of the girder with a hydraulic reaction jack 262 at the bottom (FIG. 12). The reaction jacks 262 (also referred to as damping jacks) are used to raise the bridge 200 clear when disconnecting and to lower the bridge into position when engaging. When engaging, the jacks 262 would be bypassed by a contact switch when the castors 202 attached to the girder 252 touches down allowing the bridge to "float" or be rotationally unconstrained about joint 260 until it is disconnected. When not in use the bridge 200 could be lowered to a seated position for storage (FIG. 13B). The end of the bridge is supported by large castors 202 attached to a plunger assembly 300 (FIG. 8). These could be single large wheel castors but are preferably a series of rollers to distribute the weight of the bridge.

Figure 13A:
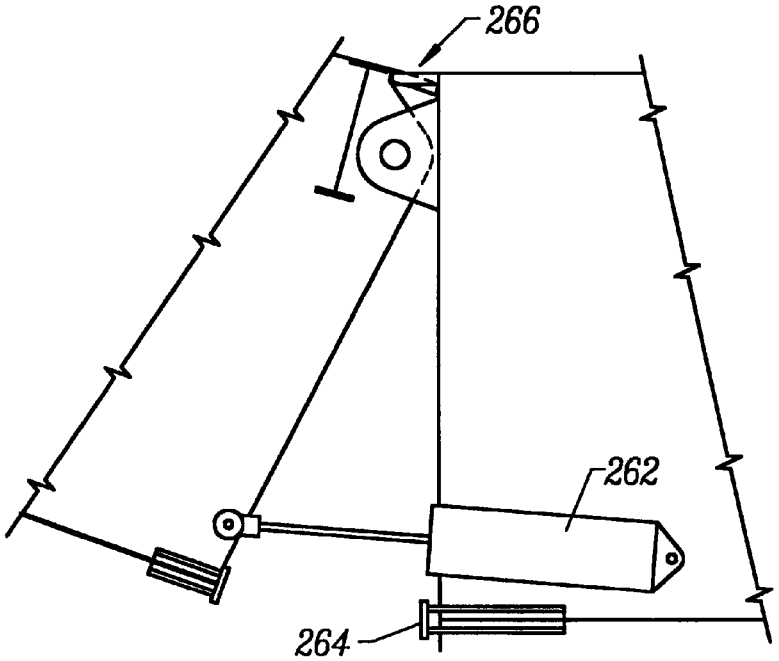
Figure 13B:
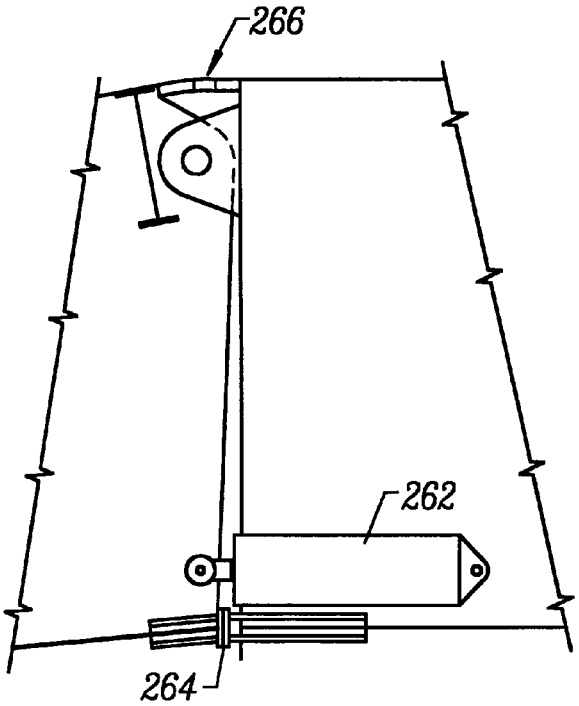

FIGS. 13A and 13B focus on the connection of the bridge near hinge 260. The figures show the upper and lower extremes in the motion of the bridge 200. In this preferred embodiment, FIG. 13A shows a maximum up angle of about 15° while FIG. 13B shows a maximum down angle of about 10°. The jack 262 is immediately above a structural stop 264. When not in use the bridge 200 would rest on the stop 264 and be inclined downwards at about 10 degrees (FIG. 13B). As can seen in the figures, reaction jack 262 is pivotally mounted about point 265 to allow it follow the range of motion of the bridge. The bridge 200 may also include interlaced finger connectors 266 which are preferably curved to maintain a substantially continuous deck surface even when the bridge 200 is in a lowered or raised configuration. The break in the connectors 266 is not nearly as pronounced at the maximum operating angle (above which flight operations cease) as that shown in FIG. 13A which is for the maximum lift case.

In a preferred embodiment, the jack 262 has a 6.6 ft. stroke to move the bridge 200 through its range of motion. The maximum jack force when lifting the bridge 200 in seastates requiring disconnect is estimated to be 2900 kips. This requires a 27 inch diameter cylinder assuming a 5,000 psi operating pressure. Additional, smaller jacks 262 could be used if necessary to reduce jack diameter. In order to lift the bridge 200 clear and not have contact between the bridge and receiving module 242 after liftoff, the bridge is preferably fully lifted in one wave cycle, or 14 seconds for the large waves in the disconnect condition. Assuming that the lift is started when the bridge is at its highest angle in the wave cycle, conservatively the jack 262 must stroke one-half its stroke, or about 3.5 ft. To obtain this lift in this time will require substantial power. The power could be supplied from very large capacity hydraulic power packs. However, it may be more appropriate to provide the power from a gas accumulator system.

Figure 14A:
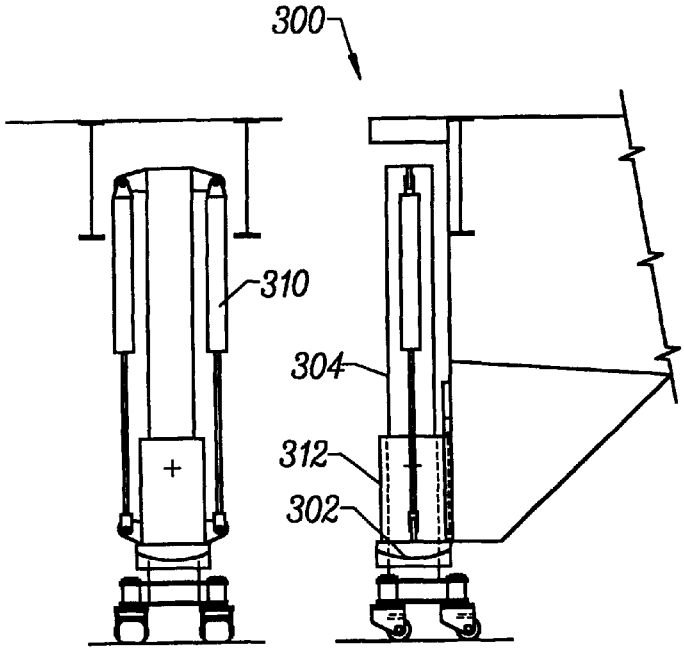
FIGS. 14A–14C are views of a plunger assembly according to the present invention.
Figure 14B:
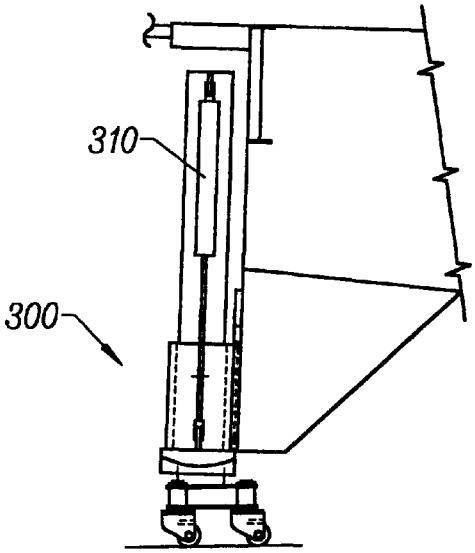
Figure 16:
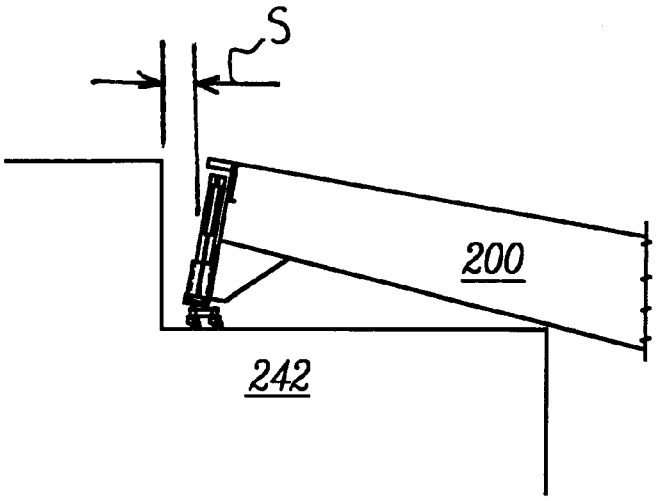

Referring to FIGS. 8, 11, and 14A–14C, the plunger assembly 300 will be described. As seen in FIG. 8, the castor wheels 202 attach to the lower portion of plunger assembly 300. They allow for translational motion of the bridge 200 on the landing zone 240. In the preferred embodiment, the width of the landing zone is set at 50 ft to allow for the 20 ft watch circle and a 5 ft margin against falling off the edge or colliding with the bulkhead. Referring now to FIG. 14A, the castor wheels 202 are coupled to the plunger assembly 300 by a spherical bearing 302. The bearing 302 is spherical to account for the many orientations that the bridge 200 may find itself in during unstable sea conditions. The bearing could be a machined bearing of impregnated bronze, or it could be made of bonded laminated elastomeric elements which deform in shear between spherical plates. Typically, the bearing need only rotate 10° maximum (FIGS. 14B and 16). This allows the bearing 302 to have a spherical surface with a large radius that places the point of rotation closer to the upper surface of the bridge 200, thus minimizing the issues of deck mismatch with module 242.

Figure 14C:
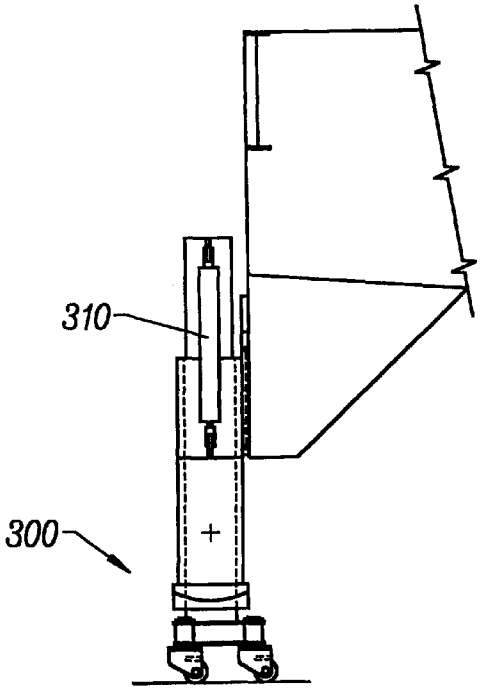

Referring to FIGS. 14B–14C, the plunger assembly 300 is used to absorb energy and provide structural support. The plunger 304 is normally fully retracted during operation and the bearing bears against the sleeve and transfers the load directly into the bridge (FIG. 14B). When the plunger is extended, the bridge dead load reaction is transferred from the bearing to the plunger and then through liftoffjacks 310 to the sleeve 312 (FIG. 14C). Under maximum load, the plunger 304 sees essentially no load since the load is transferred directly into the sleeve 312. The plunger 304 is designed by the condition when the jacks 310 have lifted the bridge off the landing area 240. At this point, friction on the rollers 202 and the component of force normal to the plunger due to the relative bridge/module angle results in a bending moment. To withstand the bending stress, the plunger 304 preferably has a size of 24 inch diameter by ⅞ inch thick pipe (FIG. 14B).

Referring to FIG. 14C, the liftoff jacks or damping jacks 310 are sized to lift the bridge dead load or approximately 300 kips for the present embodiment. This results in jacks with a 7 inch diameter cylinder at a 5,000 psi operating pressure. They act in tension under load so buckling is typically not an issue. The compression under reversal is very small, lifting only the weight of the plunger and dolly. Power is not an issue here since the speed of operation of these jacks is not critical and the load is small. However, to achieve a high speed when retracting under no load, the jacks 310 may use local gas accumulators. These jacks 310 are used primarily to facilitate engagement and disengagement of the bridge 200 by providing an initial level of clearance from landing zone 240 prior to activating jacks 262. This reduces the risk of damage to the receiving module 242 during disconnections in unstable wave conditions.

B. GAP CLOSURE ASSEMBLY

Figure 15:
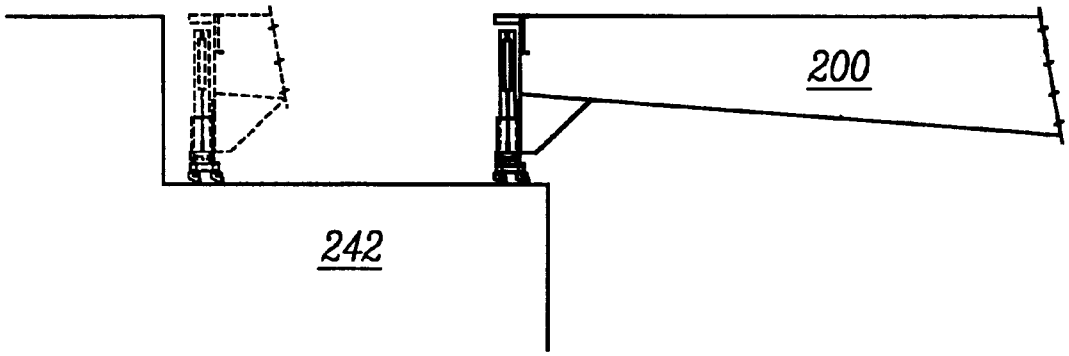
FIGS. 15–19D show embodiments of gap closure and yaw compensation assemblies according to the present invention.
Figure 17:
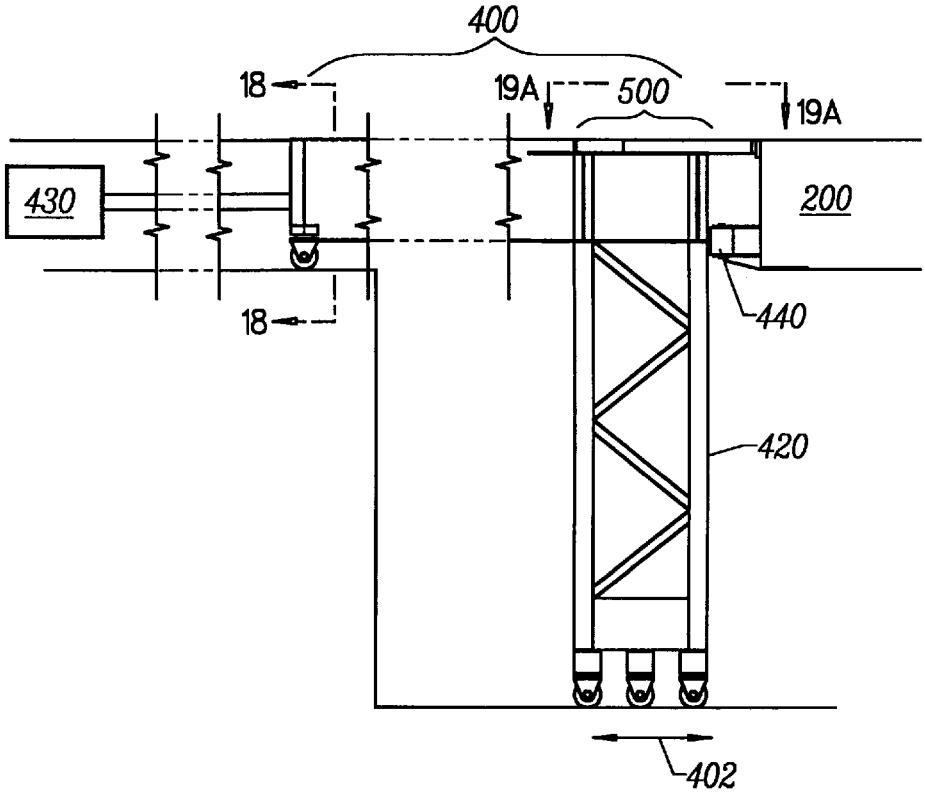
Figure 18:
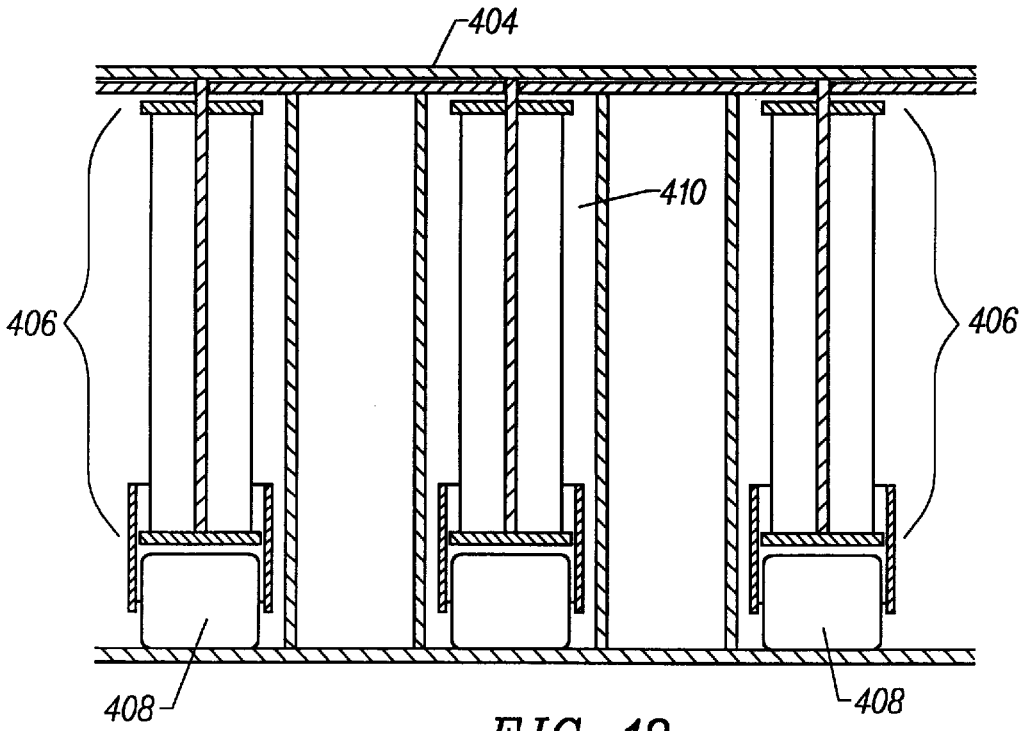
Figure 19A:
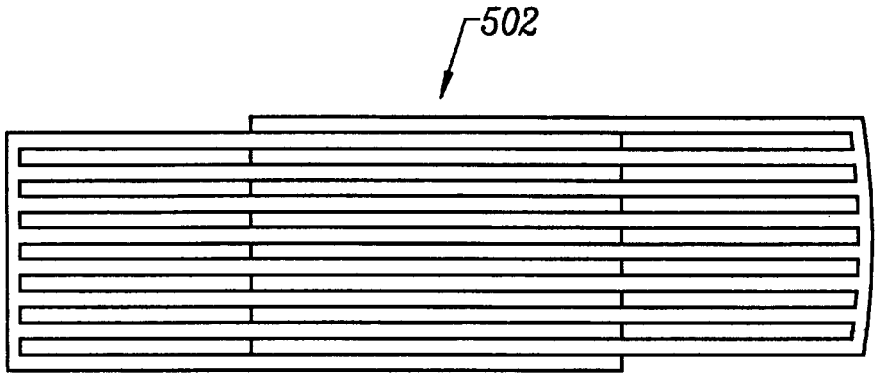
Figure 19B:
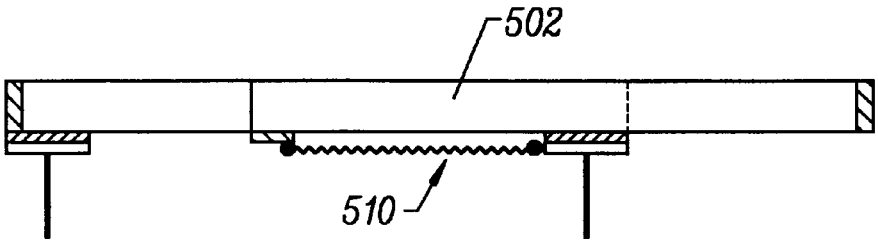
Figure 19C:
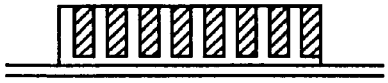
Figure 19D:
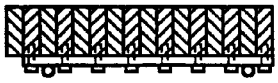

Referring now to FIGS. 15 and 16, when the bridge 200 initially engages the receiver module 242, a space S remains between the deck D of the receiver module 242 and the bridge. Since the bridge 200 rests in the landing 240 on the end of the receiving module 242, the space S between the deck D and the bridge must be filled. Referring to FIGS. 17 and 18, this is done with the gap closure assembly 400. The gap closure assembly 400 moves only in the fore-aft direction as indicated by arrow 402. As shown in FIG. 18, the moving closure unit 400 consists of a deck plate 404 supported by wide flange beams 406 spanning fore-aft between rollers 408 on the inboard end and a rolling carriage on the outboard end. The deck plate 404 makes this assembly into a rigid unit which will always move in unison. The wide flange webs 406 retract into slots 410 in the receiver module 242 deck plate. The module deck plate between the slots is supported by webs below.

Referring again to FIG. 17, the carriage 420 is supported on rollers and is pushed out by a hydraulic system 430 which maintains a low level constant compression force to keep the closure unit in contact with the bridge. Contact occurs at a central roller 440 located on the bridge. Thus the bridge 200 can travel relative to the closure unit in sway. The roller 440 also results in a gap which allows the modules to yaw relative to each other.

Figure 24:
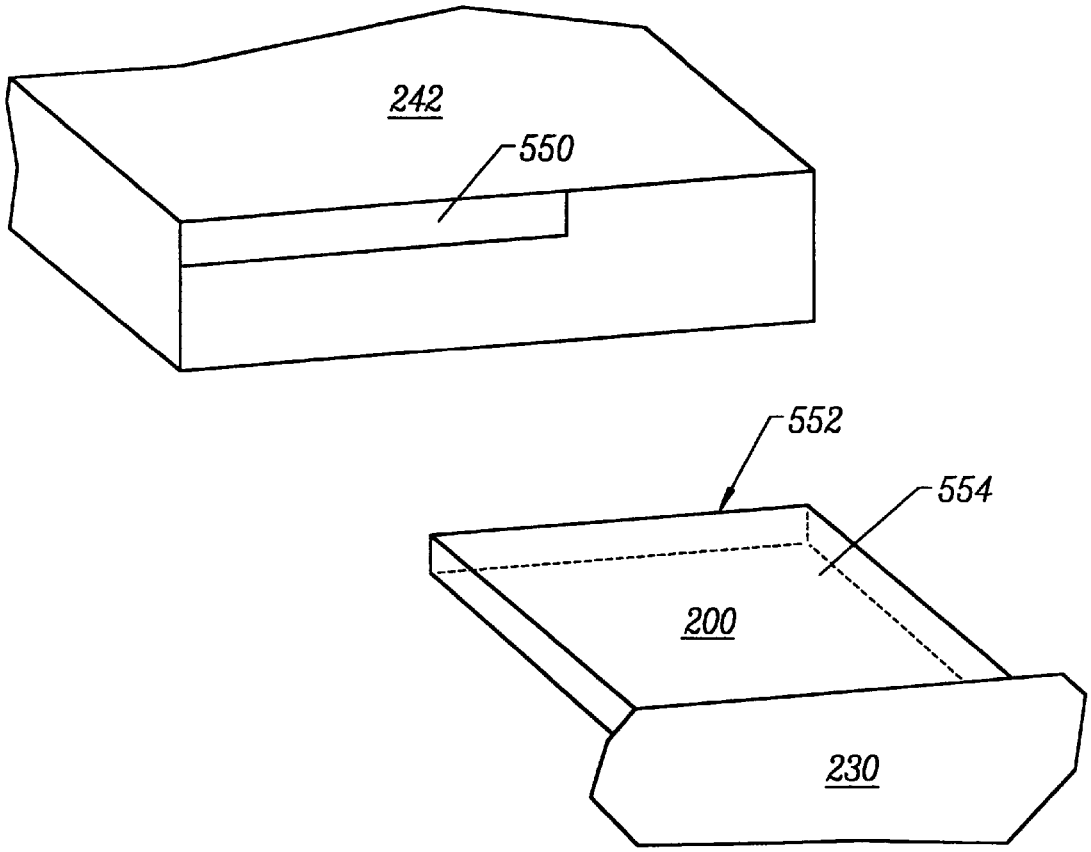

In some respects, the bridge 200 may be considered a first portion of the connector 30 and the gap closure system 400 considered a second portion of the connector. In the preferred embodiments, these portions engage over the receiver module 242. In alternative embodiments, however, it may be possible that the portions engage each other at some location over the gap G or operational distance. The first portion may have a first connecting surface and the second portion may have a second connecting surface as described in FIG. 24 below.

C. YAW COMPENSATION SYSTEM

Figure 22:
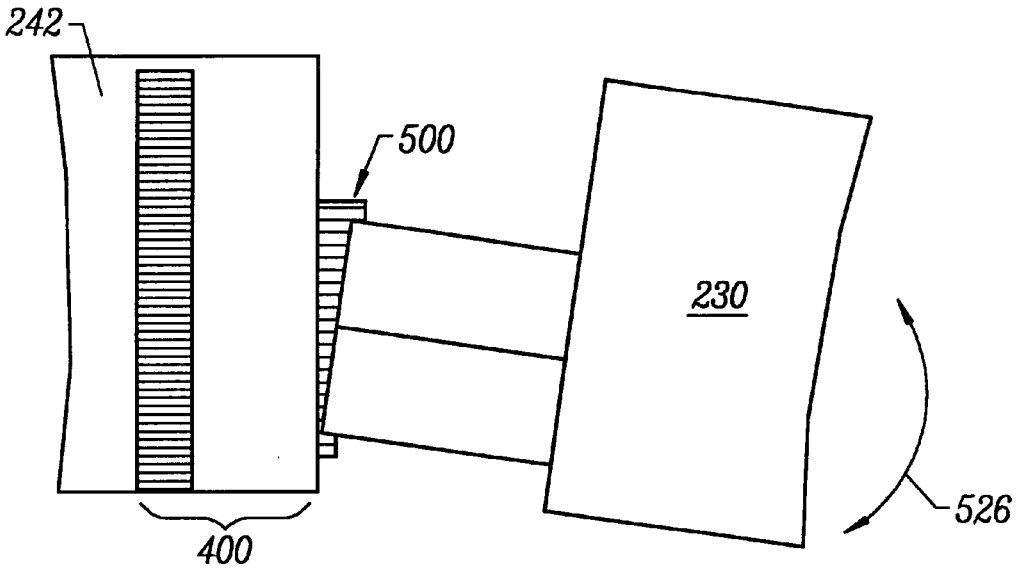

The final subassembly is the yaw compensation system 500 (FIGS. 17, 19A–D, and 22). This fills any remaining gap between the bridge 200 and the gap closure subassembly 400. The system 500 is basically a plurality of meshed expansion fingers. The fingers 502 (FIG. 19B) would be of cast steel approximately 2 ft. in horizontal length. The outboard or distal end 503 of the fingers 502 has a rounded surface to accommodate the angle caused by yaw rotation. The fingers 502 cantilever from the gap closure carriage 420 and are held down by a plate bolted into the unit from below. Compression springs 510 are shown which would keep the outboard unit normally fully extended. When the bridge 200 is engaged, the fingers 502 are compressed inwards by the contact pressure. As the bridge 200 yaws, the fingers 502 extend and compress to keep the space S closed. The bridge 200 may be provided with extension portions or wings 504 which will help compress the elements as the bridge slides laterally under sway motion (FIG. 22). In the embodiment shown, the system can handle a 3 foot gap and at least about 0.25° relative yaw between modules and preferably at least 1° yaw. A 1° yaw for a 100 ft. wide bridge results in a maximum gap less than±1 ft.

IV. OPERATION

Figure 20:
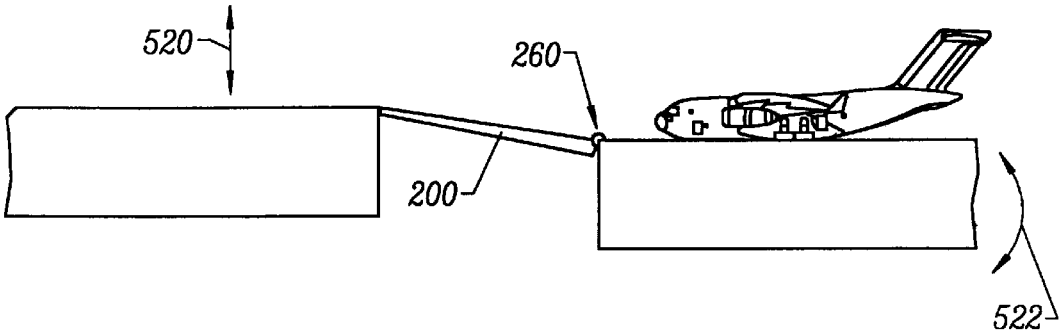
Figure 21:
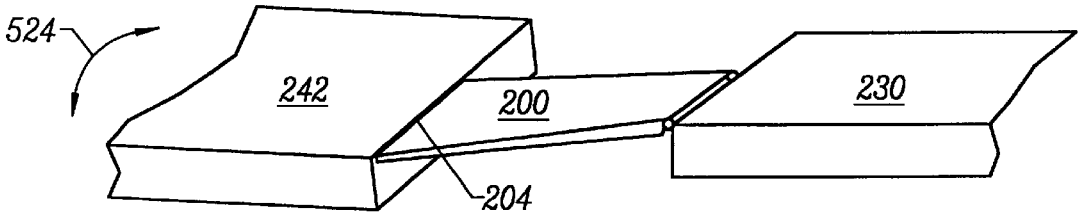
FIGS. 21–24 show the various modes of operation for a runway connector.

In operation, all six degrees of freedom are handled by the systems described above. The bridge 200 addresses relative pitch, roll and heave. As shown in FIG. 20, relative heave and pitch (indicated by arrows 520 and 522) are addressed by the hinge 260 in the bridge 200. FIG. 21 shows that the relative roll 524 between modules are handled by the torsional characteristics of the bridge 200. The weight of the typically steel bridge is sufficient to keep the distal end 204 of the bridge in contact with the receiver module 242. The bridge 200 is preferably a flexible, removable connector which maintains runway surface continuity when the modules are torsionally misaligned as shown in FIG. 21.

Relative yaw indicated by arrow 526 is handled by the yaw compensation system 500 which has individual fingers 502 which can be compressed to account for the displacement resulting from the yaw. FIG. 22 shows the yaw in an extreme manner for ease of illustration.

Figure 23:
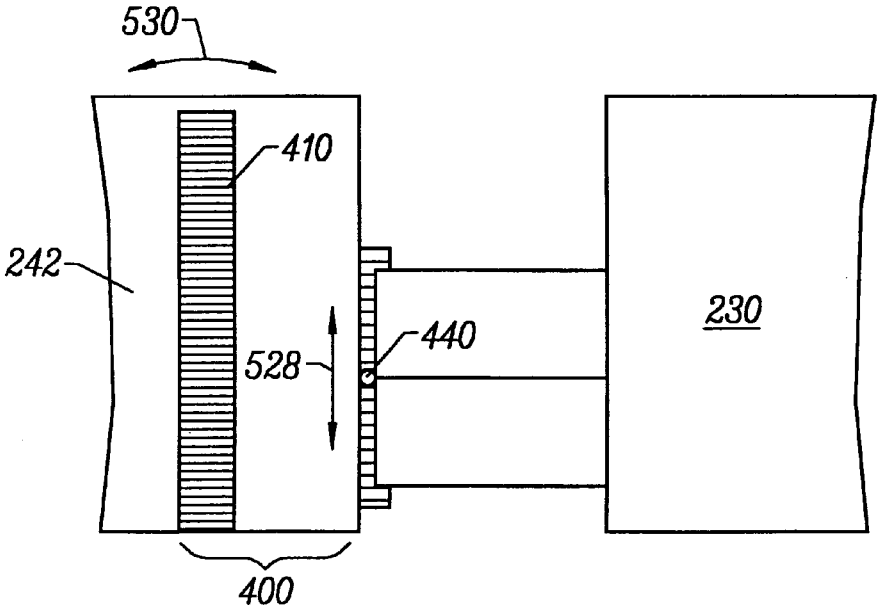

Referring to FIG. 23, relative sway 528 is handled by the roller 440 at the distal end 204 of the bridge 200. The castor wheels 202 on the landing zone 240 also facilitate lateral movement to account for sway. Relative surge 530 is handled by the expanding area created by slots 410 underneath the deck surface.

Generally speaking, in a preferred embodiment, the bridge 200 (FIG. 24) of the present invention allows an end surface 550 on the receiver module 242 to remain substantially in contact and substantially in alignment with a module end surface 552 on the bridge 200. This essentially ensures that the upper surface 554 of bridge 200 forms a continuous connection between modules and allows for the passage of wheeled vehicles and aircraft. The amount of contact and alignment will preferably be at least 80%, preferably at least 90%, and more preferably at least 95% of the area of the two surfaces. The connection between the two surfaces may be termed as a sliding interface.

Figure 25:
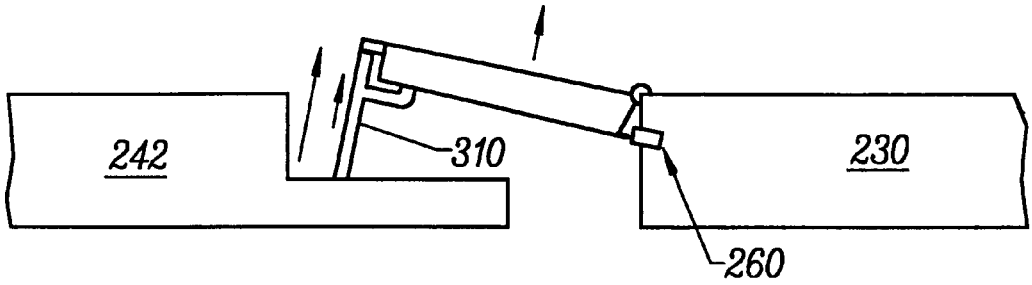
FIGS. 25–26 show the connect and disconnect procedures for the present invention.
Figure 26:
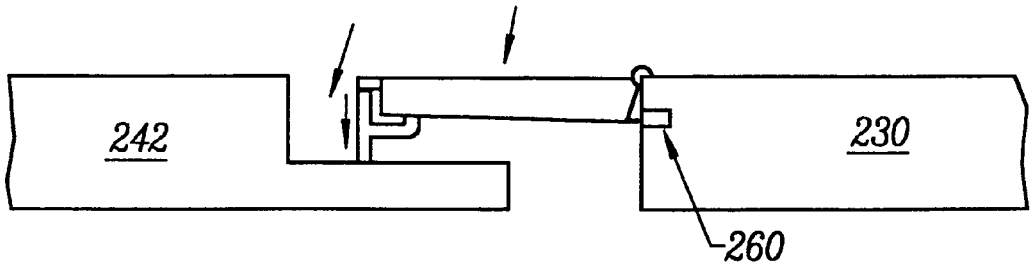

Referring to FIG. 25, operation of the system is simple and minimizes risk, both during mating and separation operations. During separation, the gap closure unit 400 is retracted to leave the landing area 240 clear. The bridge 200 is then raised to a height sufficient to ensure no contact due to heave or pitch. The jacks 310 lift the bridge upwards before the reaction jacks 260 in the donor module 230 are activated. This provides an initial level of clearance which reduces the likelihood of damage during rough seas. Note that if conditions are deteriorating the gap closure unit could be retracted if aircraft were not operating, thus minimizing the time required for an emergency disconnect. When the bridge 200 reaches its highest point in a wave cycle, the jacks 262 engage to lift the bridge. The jacks 310 quickly retract to avoid hitting any portion of the receiver module 242. In the exemplary embodiment, the bridge 200 may remain engaged up to SeaState 7 and air operations usually cease when bridge angles exceed 4°.

To connect the modules 230 and 242 together, the modules are maneuvered into position and the DP systems coordinated. The jacks 310 are extended and act as spring/damper systems to engage the landing zone 240. Once it is verified that the modules are operating in the coordinated mode the bridge is lowered. As the bridge 200 makes contact, the jacks 310 on the distal end of the bridge engage the landing zone in a spring damper mode. The jacks 310 are the locked in place once all jacks 310 have made contact. Once the jacks 310 are locked, the contact switches release the reaction jacks 262 which were lifting the bridge from the donor module, leaving the bridge spanning the gap. If necessary the relative modules locations can be adjusted to center the bridge end on the target. Once this is done, the gap closure unit 400 is pushed out and constant compression applied. The bridging is now complete.

Finally with the system as shown, maintenance and repair are relatively easy utilizing normal fabrication and machine shop capabilities. Most likely, the modules would have capability on board for normal repairs. In the worst accident with the bridge totally destroyed, damage to the modules should be minimal and bridge replacement is relatively straightforward.

Although the foregoing invention has been described in detail for purposes of clarity of understanding, it will be obvious that certain modifications may be practiced within the scope of the appended claims. For example, number of bridges used between modules may be varied. The size and number of modules used may also be varied so long as they form stable structures capable of withstanding inclimate sea states. The degree of flexibility of the bridge may be adjusted to account for increased relative roll between modules.

What is claimed is:

1. A floating platform comprising:

a first and second floating module spaced apart by a gap therebetween;

a runway bridge comprising a runway bridge extension on said first module, the runway bridge extension being arranged to extend from the first module and to be in slidable, releasable contact with the second module so as to span at least part of the gap between the modules; and a plurality of thrusters on said modules adapted to position said modules so that the runway bridge extension is retained in slidable, releasable contact with the second module so as to define a runway having a substantially continuous configuration extending across said modules;

wherein the runway bridge is adapted to allow for six degrees of motion between the modules when the runway is in the continuous configuration.

2. A floating platform of claim 1 wherein said bridge extension spans a predetermined operational distance between the adjacent modules and does not have a fixedly secured connection to one of said adjacent modules when the runway is in the continuous configuration.

3. A floating platform of claim 2 wherein said thrusters are adapted to maintain the operational distance between said modules during unstable sea conditions up to seastate 7.

4. A floating platform of claim 3 wherein said runway bridge extension comprises a ramp spanning said operational distance between the modules, said ramp in contact with said modules and providing a runway surface sufficiently continuous to allow a wheeled vehicle to roll from said first module to said second module when said modules are moving in all six degrees of freedom.

5. A floating platform of claim 2 wherein the runway bridge does not define a connection between the modules that transfers sufficient load to prevent separation of the modules from each other beyond the operational distance.

6. A floating platform of claim 1 wherein said modules each comprise a hull adapted to be submerged to a first depth during transit and a second, lower depth during operations.

7. A platform of claim 1 wherein said thrusters comprise a swivel connection to the modules.

8. A floating platform of claim 1 wherein:

the first module having the runway bridge extension acts as a donor module and the runway bridge extension is placed in slidable contact with the second module which acts as a receiver module, said runway bridge extension spanning an operational distance; and wherein the runwav bridge extension forms a first portion of the runway bridge which extends from the donor module and wherein the runway bridge further comprises a second portion which extends from the receiver module and the portions define a sliding interface between them when the runway is in the continuous configuration.

9. A floating platform of claim 8 wherein the first portion from the donor module contacts a landing region on the receiving module.

10. A floating platform of claim 8 further comprising a spring damper system located on the second portion and pushing against the first portion.

11. A floating platform of claim 8 further comprising extendable damping jacks between the first portion and the receiver module when the runway has the continuous configuration.

12. A connection assembly for spanning an operational distance between adjacent floating modules, said connection assembly comprising:

a bridge element mountable on one of said modules;

a yaw compensation assembly; and a gap closure assembly, wherein said bridge element and assemblies each form part of a substantially continuous surface extending between said adjacent modules when the connection assembly spans the operational distance.

13. A connection assembly as in claim 12 wherein the bridge element comprises girders and panels providing a longitudinally stiff and torsionally flexible structure to match roll angles between said modules.

14. A connection assembly of claim 12 wherein said yaw compensation assembly comprises a plurality of mesh expansion fingers arranged in an array.

15. A connection assembly of claim 12 wherein said gap closure assembly comprises a plurality of web flanges adapted to be extendable from a deck plate of said floating modules.

16. A connection assembly of claim 12 further comprising lift-off jacks located near the distal end of the bridge element.

17. A connection assembly of claim 12 wherein said bridge element comprises a material selected from the group consisting of steel, aluminum, and fiber-reinforced polymer.

18. A connection assembly of claim 12 further comprising:

a hinge coupling said bridge element to the one of said modules and adapted to handle relative heave and pitch between modules;

a castor wheel mounted near a distal end of the bridge element handling relative sway between modules;

said bridge element having flexibility sufficient to allow relative roll of up to 2° between modules;

said yaw compensation assembly having fingers adapted to allow relative yaw of up to about 1° between modules;

said gap closure assembly being variably extendable to allow relative surge between modules.

19. A floating platform comprising:

a plurality of floating modules; and a plurality of thrusters on said modules adapted to position portions of adjacent modules relative to each other while the modules are in releasable slidable contact with each other so as to define a runway having a substantially continuous configuration extending across, at least two of said modules;

wherein said adjacent modules define a vertically and horizontally slidable interface defining said runway.

20. A floating platform as in claim 19 further comprising a runway connector with which the adjacent modules are in releasable slidable contact with each other, the connector being arranged so as not to hold the modules in v position relative to each other nor within any predetermined operational distance between the adjacent modules.

21. A method of forming a floating runway from a plurality of floating modules, the method comprising:

positioning said plurality of floating modules relative to a position of one of said modules, such that the modules are positioned adjacent one another generally at a predetermined operational distance between each other;

using thrusters on said modules to maintain the operational distance between said modules; and maintaining a substantially continuous surface between at least two adjacent modules within the operational distance when said modules are moving in six degrees of freedom relative to one another.

22. A method as in claim 21 further comprising lowering a bridge from a donor module onto a receiving module;

maintaining a vertical and horizontal sliding interface between the modules.

23. A method as in claim 21 wherein said lowering step comprises extending jacks from the bridge;

raising jacks on the bridge to give a minimum clearance.

24. A method as in claim 21 wherein said maintaining step comprises using said thrusters to maintain said operational distance and a substantially continuous surface extending between said adjacent modules in unstable conditions up to seastate 7.

25. A method as in claim 21 further comprising:

lowering a bridge from a donor module onto a receiving module to form said continuous surface;

extending a gap closure device to contact said bridge.

26. A method as in claim 25 wherein said lowering step comprises extending jacks from the bridge to contact said receiving module prior to fully lowering the bridge;

at least partially retracting said jacks to lower the bridge onto the receiving module.

27. A method as in claim 21 further comprising raising the bridge by extending jacks mounted on the bridge to provide a partial bridge elevation before the bridge is disengaged from a receiving module.

28. A floating platform comprising:

a plurality of floating modules;

a bridge comprising a runway bridge extension on at least one of said modules;

a plurality of thrusters on said modules adapted to position said modules so as to retain the runway bridge extension in slidable, releasable contact with an adjacent module to define a runway having a substantially continuous configuration extending across the modules;

wherein the bridge is adapted to allow for six degrees of motion between the adjacent modules when the runway is in the continuous configuration;

wherein said runway bridge extension spans an operational distance between adjacent modules and does not have a fixedly secured connection to one of said adjacent modules when the runway is in the continuous configuration; and wherein the bridge does not define a connection between two adjacent modules that transfers sufficient load to prevent separation beyond the operational distance between the modules.

29. A floating platform comprising:

a plurality of floating modules;

a bridge comprising a runway bridge extension on at least one of said modules;

a plurality of thrusters on said modules adapted to position said modules so as to retain the runway bridge extension in slidable, releasable contact with an adjacent module to define a runway having a substantially continuous configuration extending across the modules;

wherein the bridge is adapted to allow for six degrees of motion between the adjacent modules when the runway is in the continuous configuration; and wherein the runway bridge extension is on a donor module and is placed in slidable contact with a receiver module, said runway bridge extension spanning an operational distance; and wherein the runway bridge extension defines a first portion of the bridge which extends from the donor module and the bridge comprises a second portion which extends from the receiver module and in which the portions define a sliding interface therebetween when the runway is in the continuous configuration.

30. A floating platform of claim 29 wherein the first portion from the donor module contacts a landing region on the receiving module.

31. A floating platform of claim 29 further comprising a spring damper system located on the second portion and pushing against the first portion.

32. A floating platform of claim 31 further comprising extendable damping jacks between the first portion and the receiver module when the runway has the continuous configuration.

33. A connection assembly for spanning an operational distance between adjacent floating modules, said connection assembly comprising:

a bridge element mountable on one of said modules;

a yaw compensation assembly;

a gap closure assembly, wherein said bridge element and assemblies form a substantially continuous surface between said adjacent modules when the connection assembly spans the operational distance; and wherein the bridge element comprises girders and panels providing a longitudinally stiff and torsionally flexible structure to match roll angles between said modules.

34. A connection assembly for spanning an operational distance between adjacent floating modules, said connection assembly comprising:

a bridge element mountable on one of said modules;

a yaw compensation assembly;

a gap closure assembly, wherein said bridge element and assemblies form a substantially continuous surface between said adjacent modules when the connection assembly spans the operational distance; and wherein said yaw compensation assembly comprises a plurality of mesh expansion fingers arranged in an array.

35. A connection assembly for spanning an operational distance between adjacent floating modules, said connection assembly comprising:

a bridge element mountable on one of said modules;

a yaw compensation assembly;

a gap closure assembly, wherein said bridge element and assemblies form a substantially continuous surface between said adjacent modules when the connection assembly spans the operational distance; and wherein said gap closure assembly comprises a plurality of web flanges adapted to be extendable from a deck plate of said floating modules.

36. A connection assembly for spanning an operational distance between adjacent floating modules, said connection assembly comprising:

a bridge element mountable on one of said modules;

a yaw compensation assembly;

a gap closure assembly, wherein said bridge element and assemblies form a substantially continuous surface between said adjacent modules when the connection assembly spans the operational distance; and lift-offjacks located near the distal end of the bridge element.

37. A connection assembly for spanning an operational distance between adjacent floating modules, said connection assembly comprising:

a bridge element mountable on one of said modules;

a yaw compensation assembly;

a gap closure assembly, wherein said bridge element and assemblies form a substantially continuous surface between said adjacent modules when the connection assembly spans the operational distance;

a hinge coupling said bridge element to one of said modules and adapted to handle relative heave and pitch between modules;

a castor wheel mounted near a distal end of the bridge element handling relative sway between modules;

said bridge element having flexibility sufficient to allow relative roll of up to 2° between modules;

said yaw compensation assembly having fingers adapted to allow relative yaw of up to about 1° between modules; and said gap closure assembly being variably extendable to allow relative surge between modules.

38. A floating platform comprising:

a plurality of floating modules; and a plurality of thrusters on said modules adapted to position portions of adjacent modules in releasable slidable contact to define a runway having a substantially continuous configuration extending between at least two of said modules;

wherein said adjacent modules define a vertically and horizontally slidable interface defining said runway; and a runway connector with which the adjacent modules are in releasable slidable contact with each other, the connector being arranged not to hold the modules in position relative to each other within a predetermined operational distance between the adjacent modules.

* * * * *